US007311056B1

(12) United States Patent
Krogstad

(10) Patent No.: US 7,311,056 B1
(45) Date of Patent: Dec. 25, 2007

(54) PONTOON FLOAT TOWABLE BEHIND A WATERCRAFT

(76) Inventor: Robert Krogstad, P.O. Box 842, Kasilof, AK (US) 99610

( * ) Notice: Subject to any disclaimer, the term of this patent is extended or adjusted under 35 U.S.C. 154(b) by 0 days.

(21) Appl. No.: 11/446,677

(22) Filed: Jun. 5, 2006

(51) Int. Cl.
*B63B 21/56* (2006.01)

(52) U.S. Cl. ..... 114/242; 114/347

(58) Field of Classification Search ..... 114/242, 114/249, 250, 253, 230.15, 352–354, 345, 114/61.1, 61.22–61.25; 224/184
See application file for complete search history.

(56) References Cited

U.S. PATENT DOCUMENTS

| | | | | |
|---|---|---|---|---|
| 3,812,805 | A | 5/1974 | Forssell et al. | |
| 4,762,078 | A | 8/1988 | Palmer, Jr. | |
| 4,915,047 | A * | 4/1990 | Lord et al. | 114/39.26 |
| 5,090,714 | A | 2/1992 | Seekins et al. | |
| 5,174,232 | A | 12/1992 | Boddy | |
| 5,188,054 | A * | 2/1993 | Jacobs, Jr. | 114/250 |
| 5,421,757 | A | 6/1995 | Basiliere | |
| 5,490,471 | A | 2/1996 | Haggerty | |
| 5,529,008 | A | 6/1996 | Craig | |
| D390,528 | S | 2/1998 | Roberson | |
| 6,295,943 | B1 * | 10/2001 | Brushaber et al. | 114/253 |
| 6,640,741 | B1 * | 11/2003 | Myers | 114/352 |
| 2004/0083942 | A1 | 5/2004 | Dunn | |
| 2004/0116011 | A1 | 6/2004 | Jackson | |
| 2006/0003646 | A1 | 1/2006 | Hendrickson | |

OTHER PUBLICATIONS

TOPKAYAKER.NET article. Oct. 2, 2003.*

* cited by examiner

*Primary Examiner*—Ed Swinehart

(57) ABSTRACT

An apparatus for towing cargo behind a watercraft that includes a floating assembly for towing behind the watercraft and comprising a frame and at least one floatation device mounted on the frame. The apparatus further includes a linking assembly mounted on the floating assembly for linking the floating assembly to the watercraft. The linking assembly comprises a pair of longitudinal linking elements, with each of the linking elements having a forward end and a rear end. The rearward end of each of the linking elements is mounted on the floating assembly and extends forwardly from the floating assembly for mounting on the watercraft.

19 Claims, 4 Drawing Sheets

PONTOON FLOAT TOWABLE BEHIND A WATERCRAFT

BACKGROUND OF THE INVENTION

1. Field of the Invention

The present invention relates to watercraft and more particularly pertains to a new pontoon float towable behind a watercraft for increasing the amount of supplies and other items that may be transported when operating the watercraft.

2. Description of the Prior Art

Watercraft, especially relatively small watercraft such as kayaks, are a popular means of recreation for outdoors people. The relatively small size of these craft make them easy to paddle and maneuver by a single person. However, while there is typically some provision on these small craft for carrying provisions, the small size of the craft significantly limits the amount of such provisions that may be carried, and overloading the craft can make the craft unstable and more difficult to maneuver. While this limitation may not affect a day-long trip using the watercraft, it can limit the user's ability to take journeys of longer duration into wilderness, such as overnight or over a number of days, as the greater quantity of provisions required cannot be safely carried by the water craft. The user is thus face with the dilemma of taking only shorter trips that do not require a significant amount of pack and food, or use a larger craft that is able to carry the provisions but is less easily paddled and maneuvered than the small craft.

It is therefore believed that there exists a need for a solution to this problem that does not require the user to obtain a larger craft for occasional longer excursions, but does allow for the carrying of larger amounts of provisions on those occasions that this capability is needed.

SUMMARY OF THE INVENTION

In view of the foregoing disadvantages inherent in the known types of watercraft now present in the prior art, the present invention provides a new pontoon float towable behind a watercraft wherein the same can be utilized for increasing the amount of supplies and other items that may be transported when operating the watercraft when such additional capacity is needed.

To attain this, the present invention generally comprises an apparatus for towing cargo behind a watercraft that includes a floating assembly for towing behind the watercraft. The floating assembly comprises a frame and at least one floatation device mounted on the frame. The apparatus further includes a linking assembly mounted on the floating assembly for linking the floating assembly to the watercraft. The linking assembly comprises a pair of longitudinal linking elements, with each of the linking elements having a forward end and a rear end. The rearward end of each of the linking elements is mounted on the floating assembly and extends forwardly from the floating assembly for mounting on the watercraft.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is that the user of a watercraft, and especially a small watercraft, is able to add greater cargo carrying capacity to the water craft when needed, without having to obtain a larger craft, so the small watercraft may be used for journeys of greater lengths of time than would be possible if the user was limited to the cargo carrying capacity of the craft itself. Further, the stability and handling is not dangerously degraded, such as may occur when the craft is overloaded with cargo.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
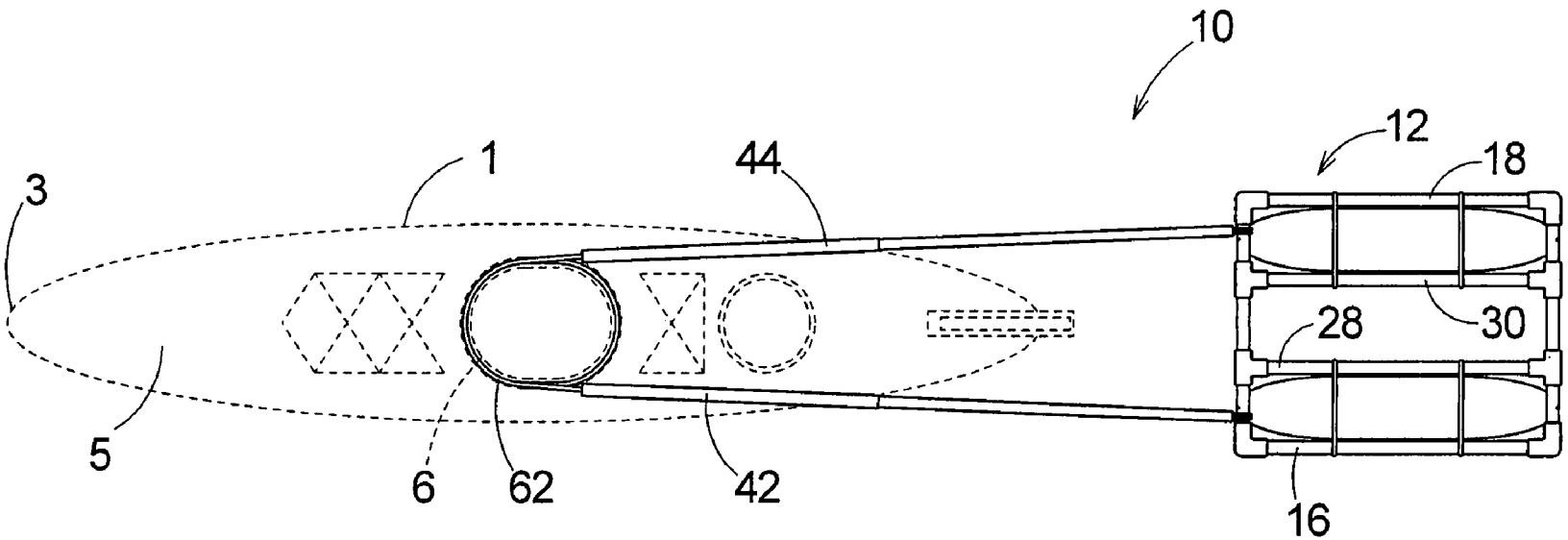
FIG. 1 is a schematic top view of a new pontoon float towable behind a kayak according to the present invention.
Figure 2:
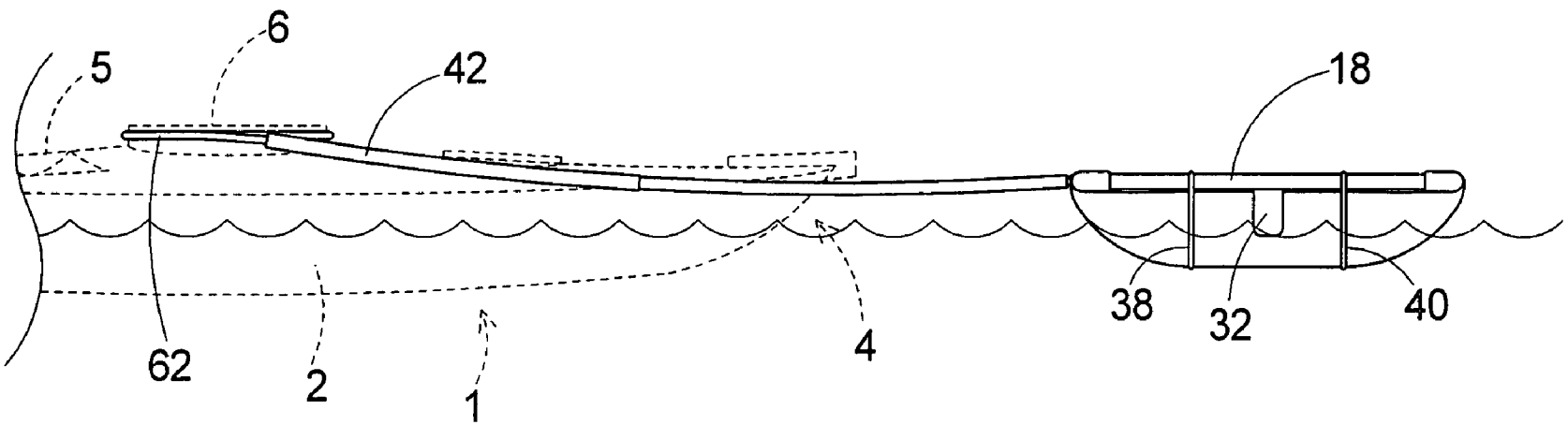
FIG. 2 is a schematic side view of one variation of the present invention.
Figure 3:
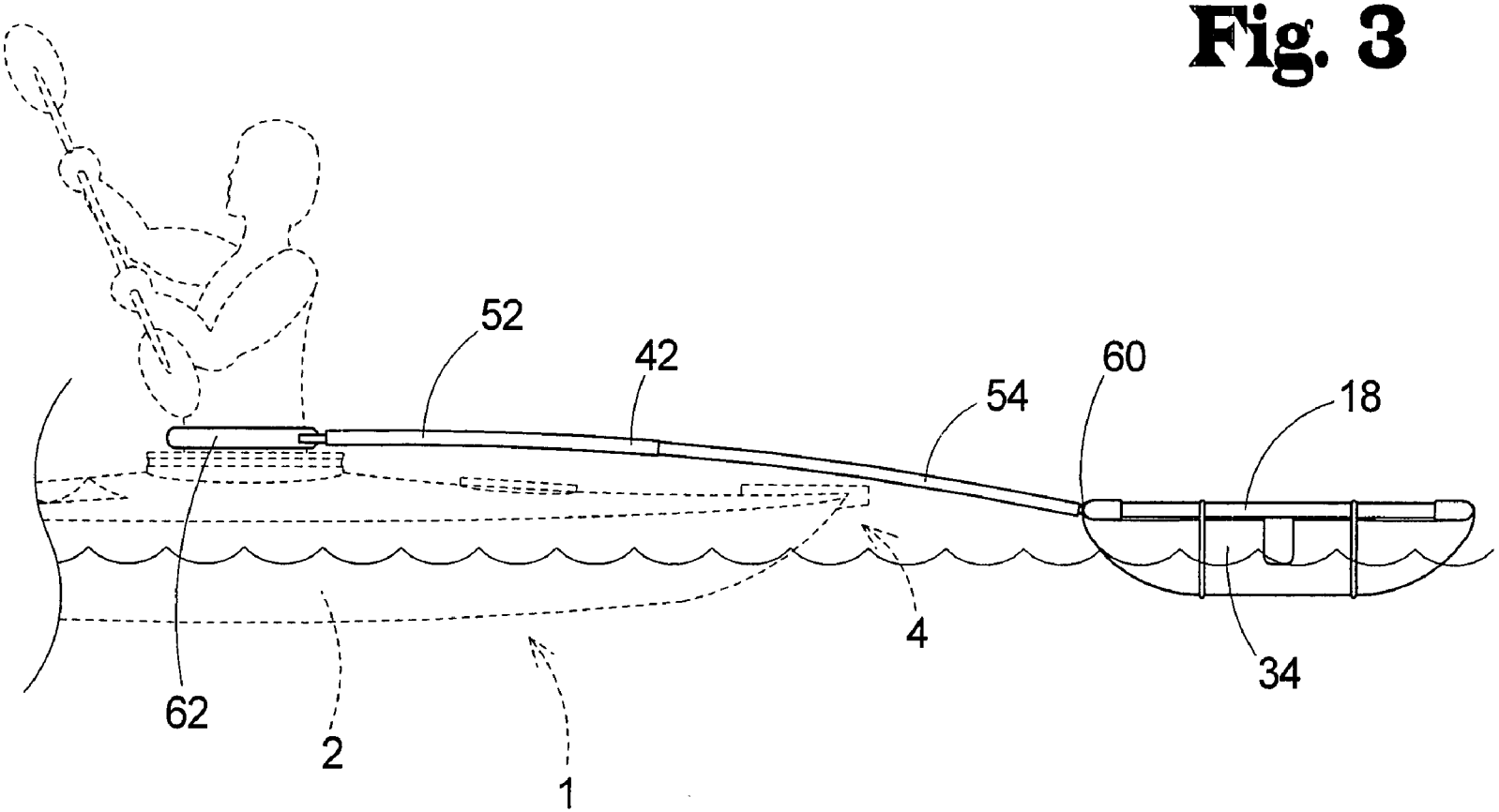
FIG. 3 is a schematic side view of another variation of the present invention.
Figure 4:
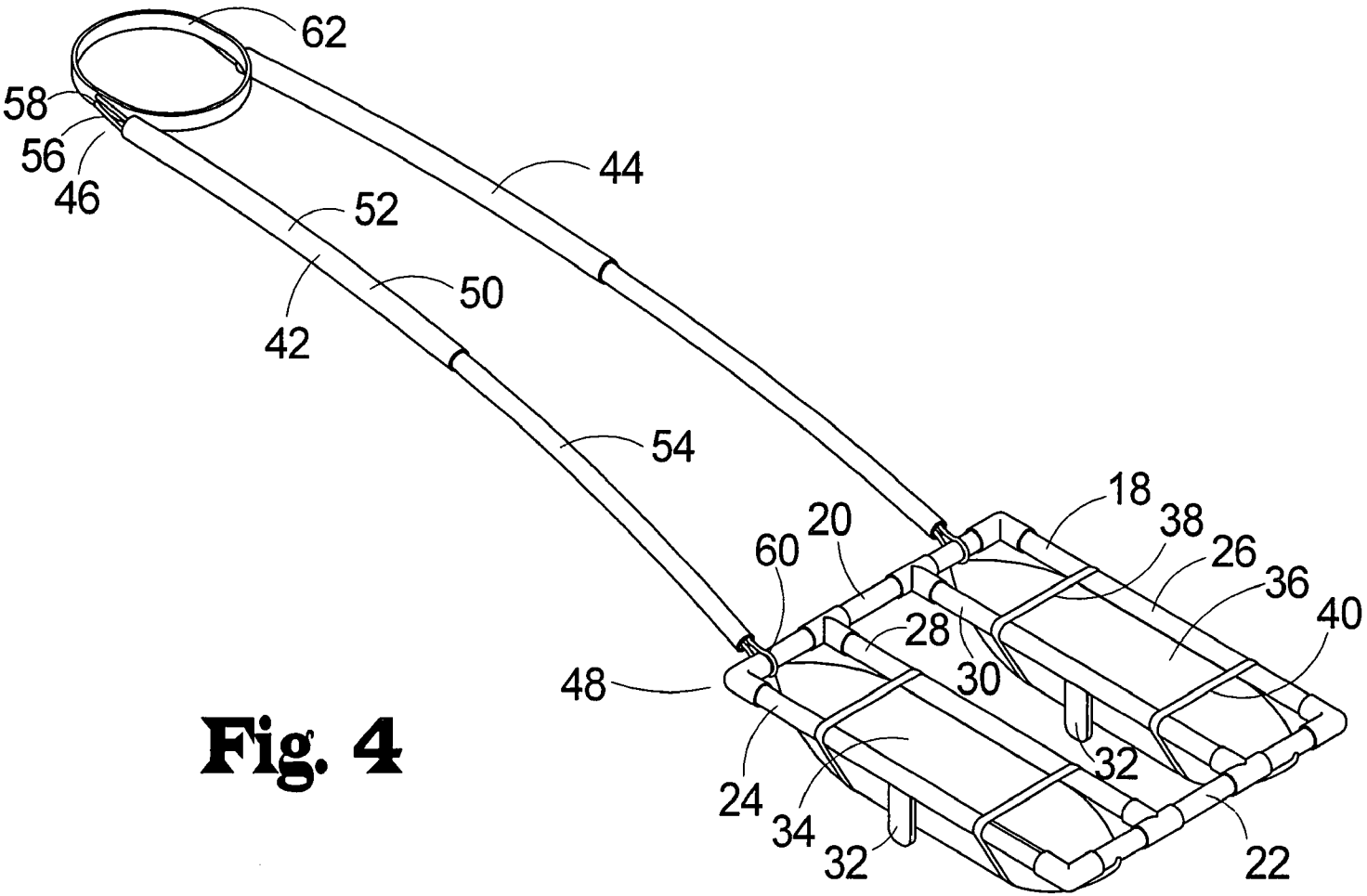
FIG. 4 is a schematic perspective view of the present invention.

With reference now to the drawings, and in particular to FIGS. 1 through 4 thereof, a new pontoon float towable behind a kayak embodying the principles and concepts of the present invention and generally designated by the reference numeral 10 will be described.

As best illustrated in FIGS. 1 through 4, the pontoon float apparatus 10 that is towable behind a watercraft 1 and generally comprises a floating assembly 12 and a linking assembly 14 that links the floating assembly 12 to the floating assembly. The watercraft 1 may be of the type that has a hull 2 with a bow end 3 and a stern end 4, and the hull 2 may have an upper surface 5. In one application of the invention, the watercraft 1 is a kayak, and includes an opening 6 for accommodating a user seated on the watercraft. It will be recognized by those skilled in the art that the invention is not specific to any one particular type of watercraft, although the invention is highly suitable for use with a kayak or similar small craft.

Turning first to the floating assembly 12 of the invention, a frame 16 for supporting any cargo to be carried by the apparatus 10, and the frame may be enhanced with various structures to support the cargo, including a plate (not shown) positioned on a top of the frame for supporting the cargo. The frame 16 may include one or more portions. In the illustrative example, the frame 16 includes an outer perimeter portion 18 that may extend substantially along an outer perimeter of the floating assembly 12. The outer perimeter portion 18 may include a front section 20, a rear section 22, and a pair of side sections 24, 26 that extend between the front 20 and rear 22 sections. In some embodiments of the invention, the front 20 and rear 22 sections may be oriented substantially perpendicular to the pair of side sections 24, 26. In the illustrative embodiment of the invention, each of the sections is comprised of lightweight element that is relatively rigid. In one embodiment, the sections of the frame may comprise a tubular element formed of plastic, such as pipe or tubing formed of polyvinyl chloride. If constructed in a manner that makes any connection air tight, the tubing may provide additional floatation to the floating assembly 12. Those skilled in the art will recognize that other materials and configurations could be employed.

The frame 16 may also include at least one cross member portion 28 that extends across the outer perimeter portion 18, and the cross member portion may be joined to opposite sections or locations of the outer perimeter portion. The cross member portion 28 may extend in a longitudinal direction of the floating assembly 12 between the front section 20 and the rear section 22. In the illustrative embodiment, a pair of the cross member portions 28, 30 may be employed, but again it will be recognized by those skilled in the art that the number of cross member portions may be varied without departing from the spirit of the invention. Thus, the number and character of the cross member portions may be varied to provide additional or specialized mounting points for cargo being carried by the floating assembly 12.

The frame 16 may also include at least one positioning member portion 32 for positioning a floatation device below the frame 16. The positioning member portion 32 may extend downwardly from one or more of the portions of the frame 16. In the illustrative embodiment, a positioning member portion 32 extends downwardly from each of the cross member portions 28, 30, and a positioning member portion 32 extends downwardly from each of the side sections 24, 26 of the outer perimeter portion 18.

The floating assembly 12 may also include at least one floatation device 34 that is mounted on the frame 16, and is preferably, although not necessarily, removably mounted on the frame. The floatation device 34 may be elongated, and may extend longitudinally of the floating assembly 12. The floatation device 34 is configured to be buoyant such that it floats on water. In the illustrative embodiment, the floatation device 34 may comprise a bladder that is capable of receiving and holding a gaseous material, such as air, and may provide the capability of removing the air from the bladder between uses of the invention. A pair of floatation devices 34, 36 may be employed on the floating assembly 12, although more flotation devices may be employed, particularly as the size of the floating assembly is increased.

The floating assembly 12 may also be provided with means for securing the floatation device 34 to the frame 16, preferably but not critically in a removable manner. At least one securing member 38 may be employed for this purpose. The securing member 38 may be elongate for wrapping about one of the floatation devices 34, 36 and a portion of the frame 16. The securing member 38 may be resiliently extensible to permit the member 38 to be stretched while exhibiting resistance to the stretching. The securing member 38 may also be flexible. In the illustrative embodiment, a pair of the securing members 38, 40 are provided for each of the floatation devices 34, 36, and each of the securing members is removably securable about the floatation member and a portion of the frame 16, such as, for example, one of the side sections 24, 26 of the outer perimeter portion 18 of the frame 16 and one of the cross member portions 28, 30. The positioning member portion 32 may resist any significant longitudinal slippage of the securing members 38, 40 with respect to the frame 16.

The linking assembly 14 of the invention functions to link the floating assembly 12 to the watercraft 1, and is mounted on the floating assembly for that purpose. The mounting to the floating assembly 12 may be permanent, but is preferably removable to enhance the transportability of the assemblies. The linking assembly 14 may also be configured to mount to the watercraft 1 is a manner described below. The linking assembly 14 may include a pair of longitudinal linking elements 42, 44. Each of the linking elements 42, 44 has a forward end 46 and a rear end 48. The rearward end 48 of each of the linking elements is connected to the frame 16 of the floating assembly 12, and may be connected to the frame 16 at laterally spaced locations on the frame. Although other connection configurations may be possible, the laterally space configuration has the benefit of helping to keep the floating assembly upright, even in rough water conditions, and also helps to main the floating assembly in the desired position behind the watercraft, even when the watercraft is not moving forwardly.

Each of the linking elements 42, 44 may comprise a tubular structure that extend between the forward 46 and rearward 48 ends. The tubular structure 50 may have a passage extending therethrough between the forward 46 and rearward 48 ends. The tubular structure 50 may be substantially rigid, although some flexibility may be permitted, to help keep the frame 16 of the floating assembly at a constant distance from the mounting point on the watercraft, which can prevent the floating assembly 12 from hitting the watercraft. The tubular structure 50 may have an opening at each of the forward 46 and rearward 48 ends of the linking element 42, 44 that opens in to the passage in the structure 50. In one embodiment of the invention, the tubular structure 50 may include a forward section 52 and a rearward section 54 that are removably mounted together to permit the sections 52, 54 to be disconnected and collapsed during times of non-use, such as times of transport and storage.

Each of the linking elements 42, 44 may also include a flexible structure 56 that extends through the tubular structure 50 between the opposite ends 46, 48. The flexible structure 56 may have a front end 58 and a rearward end 60. The rearward end 60 may be connected to the frame 16, and may be removable connected to facilitate removal for transport and storage. The tubular structure 50 may be slidable along the flexible structure 56. In the illustrative embodiment, the flexible structure 56 may comprise a rope or cord or cable that extends through the passage in the tubular structure 50, and is tied or otherwise looped about one of the front sections 20 of the frame.

Optionally, each of the linking elements 42, 44, and more specifically, the tubular structures 50, may be arcuate in shape between the forward 46 and rearward 48 ends such that the elements 42, 44 may be arched in an upward direction, to facilitate clearance of the stern end 4 of the watercraft 1 passing below the elements 42, 44.

The linking assembly 14 may also include a mounting structure 62 for removably mounting the pair of longitudinal linking elements 42, 44 to the watercraft 1, either directly, or through a user seated in the watercraft. The forward ends 46 of the linking elements 42, 44 may be connected to the mounting structure, and more specifically, the forward ends 58 of the flexible structure 56 may be connected to the mounting structure. The linking elements 42, 44 may be secured to substantially opposite locations on the mounting structure 62. The mounting structure 62 may include a band or belt, which may be substantially circular in shape. This band may be mounted on the torso of the user while the user is seated in the watercraft, to thus connect the linking elements to the watercraft. The band may also be directly connected or attached to the watercraft, such as at a location about the opening 6 of the watercraft.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for towing cargo behind a watercraft, comprising:

a floating assembly for towing behind the watercraft, the floating assembly including a frame and at least one floatation device mounted on the frame; and a linking assembly mounted on the floating assembly for linking the floating assembly to the watercraft, the linking assembly comprising a pair of longitudinal linking elements, each of the linking elements having a forward end and a rear end, the rearward end of each of the linking elements being mounted on the floating assembly and extending forwardly from the floating assembly;

wherein the linking assembly further includes a substantially circular element configured to encircle user when the user is seated in an opening in a hull of the watercraft.

2. The apparatus of claim 1 wherein the linking elements are mounted on the floating assembly at laterally spaced locations with respect to each other.

3. The apparatus of claim 1 wherein each of the linking elements comprises a more rigid element and a more flexible element mounted on the more rigid element, each of the elements extending substantially from the forward end to the rearward end of the linking element.

4. The apparatus of claim 1 wherein each of the linking elements comprises:

a tubular structure extending between the forward and rearward ends of the linking elements, the tubular structure having a passage between the forward and rearward ends; and a flexible structure extending through the passage of the tubular structure between the forward and rearward ends, the flexible structure having a front end and a rearward end, the rearward end being connected to the floating assembly.

5. The apparatus of claim 1 wherein each of the linking elements has a longitudinal axis extending between the forward and rearwards ends of the linking element, the longitudinal axis being arcuate between the forward and rearward ends.

6. The apparatus of claim 4 wherein the flexible structure comprises a rope extending through the passage in the tubular structure.

7. The apparatus of claim 5 wherein each of the linking elements is arched in an upward direction between the forward and rearwards ends of the linking element.

8. The apparatus of claim 1 wherein the substantially circular element comprises a band configured to connect to the watercraft in a position adapted for encircling the user seated in an opening in a hull of the watercraft.

9. The apparatus of claim 1 wherein the substantially circular element comprises a belt mountable on the torso of the user while seated on the watercraft.

10. The apparatus of claim 1 wherein the frame comprises an outer perimeter portion extending substantially along an outer perimeter of the floating assembly.

11. The apparatus of claim 10 wherein the frame comprises at least one cross member portion extending across the outer perimeter portion, the at least one cross member being joined to opposite sections of the outer perimeter portion.

12. The apparatus of claim 11 wherein the frame comprises at least one positioning member portion for positioning the floatation device below the frame, the at least one positioning member portion extending downwardly from one of the portions of the frame.

13. The apparatus of claim 12 wherein the at least one positioning member portion extends downwardly from the cross member portion and from the outer perimeter portion.

14. The apparatus of claim 1 wherein the at least one floatation device is removable from the frame.

15. The apparatus of claim 1 wherein the at least one floatation device comprises an elongated bladder capable of receiving and holding a gas.

16. The apparatus of claim 1 wherein the floating assembly includes securing means for removably securing the at least one floatation device to the frame.

17. The apparatus of claim 1 wherein the at least one floatation device comprises a pair of floatation devices;

wherein the linking elements are mounted on the floating assembly at laterally spaced locations with respect to each other;

wherein each of the linking elements comprises:

a tubular structure extending between the forward and rearward ends of the linking elements, the tubular structure having a passage between the forward and rearward ends; and a flexible structure extending through the passage of the tubular structure between the forward and rearward ends, the flexible structure having a front end and a rearward end, the rearward end being connected to the floating assembly;

wherein each of the linking elements is arcuate between the forward and rearward ends;

wherein each of the tubular structures includes a forward section and a rearward section removably mounted together;

wherein the flexible structure comprises a cord extending through the passage in the tubular structure;

wherein the linking assembly further comprises a mounting structure for removably mounting the pair of longitudinal linking elements to one of the watercraft and a user seated in the watercraft;

wherein the frame comprises an outer perimeter portion extending substantially along an outer perimeter of the floating assembly;

wherein the frame comprises a pair of cross member portions extending across the outer perimeter portion, the cross member portions being joined to opposite sections of the outer perimeter portion;

wherein the frame comprises a pair of positioning member portions for positioning the floatation device below the frame, the at least one positioning member portion extending downwardly from one of the portions of the frame;

wherein the pair of positioning member portions extend downwardly from the cross member portion and from the outer perimeter portion;

wherein the floatation devices are removable from the frame;

wherein the floatation devices each comprise an elongated bladder capable of receiving and holding a gas; and wherein the floating assembly includes securing means for removably securing the floatation devices to the frame, the securing means comprising a pair of securing members for wrapping about each of the floatation devices and a portion of the frame.

18. An apparatus for towing cargo behind a watercraft, comprising:

a floating assembly for towing behind the watercraft, the floating assembly including a frame and at least one floatation device mounted on the frame; and a linking assembly mounted on the floating assembly for linking the floating assembly to the watercraft, the linking assembly comprising a pair of longitudinal linking elements, each of the linking elements having a forward end and a rear end, the rearward end of each of the linking elements being mounted on the floating assembly and extending forwardly from the floating assembly for mounting on the watercraft;

a tubular structure extending between the forward and rearward ends of the linking elements, the tubular structure having a passage between the forward and rearward ends; and a flexible structure extending through the passage of the tubular structure between the forward and rearward ends, the flexible structure having a front end and a rearward end, the rearward end being connected to the floating assembly;

wherein each of the tubular structures includes a forward section and a rearward section removably mounted together.

19. An apparatus for towing cargo behind a watercraft, comprising:

a floating assembly for towing behind the watercraft, the floating assembly including a frame and at least one floatation device mounted on the frame; and a linking assembly mounted on the floating assembly for linking the floating assembly to the watercraft, the linking assembly comprising a pair of longitudinal linking elements, each of the linking elements having a forward end and a rear end, the rearward end of each of the linking elements being mounted on the floating assembly and extending forwardly from the floating assembly;

wherein each of the linking elements has a longitudinal axis extending between the forward and rearwards ends of the linking element, the longitudinal axis being arcuate between the forward and rearward ends; and wherein each of the linking elements is arched in an upward direction between the forward and rearwards ends of the linking element.

* * * * *